US008173926B2

(12) United States Patent
Becker et al.

(10) Patent No.: US 8,173,926 B2
(45) Date of Patent: May 8, 2012

(54) ELECTRICAL SWITCHING DEVICE WITH A THERMAL RELEASE

(75) Inventors: Joachim Becker, Schwetzingen (DE); Thilo Bahlinger, Rülzheim (DE); Alexander Orban, Weinheim (DE); Klaus Zimmer, Wiesloch (DE)

(73) Assignee: ABB AG, Mannheim (DE)

( * ) Notice: Subject to any disclaimer, the term of this patent is extended or adjusted under 35 U.S.C. 154(b) by 125 days.

(21) Appl. No.: 12/787,627

(22) Filed: May 26, 2010

(65) Prior Publication Data

US 2010/0301015 A1 Dec. 2, 2010

(30) Foreign Application Priority Data

May 30, 2009 (DE) ..... 10 2009 023 556

(51) Int. Cl.
*H01H 33/18* (2006.01)

(52) U.S. Cl. ..... 218/38; 218/151; 335/201

(58) Field of Classification Search ..... 218/38, 218/151; 335/201
See application file for complete search history.

(56) References Cited

U.S. PATENT DOCUMENTS 4,417,222 A * 11/1983 Schmitt et al. ..... 335/6
4,656,446 A * 4/1987 Chien et al. ..... 335/201
6,262,384 B1 7/2001 Niebler
6,518,530 B2 * 2/2003 Heins et al. ..... 218/38
7,081,596 B2 * 7/2006 Schneider et al. ..... 218/22
7,495,190 B2 * 2/2009 Kuhrt et al. ..... 218/149
7,723,634 B2 * 5/2010 Annis et al. ..... 218/148
2009/0321393 A1 12/2009 Bahlinger

FOREIGN PATENT DOCUMENTS

DE 4315485 A1 11/1994
DE 29720715 U1 1/1998
DE 102007005997 A1 8/2008

* cited by examiner

*Primary Examiner* — Truc Nguyen
(74) *Attorney, Agent, or Firm* — Anthony M. Del Zoppo, III; Driggs, Hogg, Daugherty & Del Zoppo Co. LPA

(57) ABSTRACT

The invention describes an arc-quenching arrangement for an electrical service switching device, with a fixed contact piece, a movable contact piece, with an arc splitter stack having arc splitter plates, each arc splitter plate having a cutout which is open towards the arc formation point, has a V-shaped notch and tapers in the form of a funnel in the arc running direction, and the arc being guided into the arc splitter stack via a first arc guide rail, which is associated with the fixed contact piece, and a second arc guide rail, which is associated with the movable contact piece. The first arc guide rail has a first, rectangular section, which faces the arc formation location, and a second section, which adjoins the first section and is in the form of a rectangular trapezium and whose first limb extends at an angle with respect to the mid-longitudinal axis of the first section and away therefrom.

22 Claims, 3 Drawing Sheets

ELECTRICAL SWITCHING DEVICE WITH A THERMAL RELEASE

CROSS-REFERENCE TO RELATED APPLICATION

This application claims priority of German Application Serial No. 10 2009 023 556.6, filed May 30, 2009, entitled ELECTRICAL SWITCHING DEVICE WITH A THERMAL RELEASE.

DESCRIPTION

The invention relates to an arc-quenching arrangement for an electrical service switching device, with a fixed contact piece, a movable contact piece, with an arc splitter stack having arc splitter plates, each arc splitter plate having a cutout which is open towards the arc formation point, has a V-shaped notch and tapers in the form of a funnel in the arc running direction, and the arc being guided into the arc splitter stack via a first arc guide rail, which is associated with the fixed contact piece, and a second arc guide rail, which is associated with the movable contact piece, in accordance with the precharacterizing clause of Claim 1.

The invention furthermore relates to an electrical service switching device, in particular line circuit breaker, with a fixed contact piece and a movable contact piece, with an arc splitter stack having arc splitter plates, each arc splitter plate having a cutout, which is open towards the arc formation point, has a V-shaped notch and tapers in the form of a funnel in the arc running direction, and the arc being guided into the arc splitter stack via a first arc guide rail, which is associated with the fixed contact piece, and a second arc guide rail, which is associated with the movable contact piece, in accordance with the precharacterizing clause of Claim 12.

An arc-quenching arrangement of the generic type is known in principle and disclosed, for example, in DE 40 41 887 A1. DE 10 200 303 A1 likewise discloses an arc-quenching arrangement of the generic type, in which the arc guide rail, which is associated with the fixed contact piece, is rectangular and corresponds in terms of its outer contour to the arc splitter plate adjacent thereto.

In the light of the prior art, the present invention is based on the object of developing an arc splitter plate arrangement of the generic type and an electrical switching device of the generic type in such a way that the arc run is improved and thus the switching capacity and the current limitation are increased.

The object addressed by the invention is achieved according to the invention as regards an arc-quenching arrangement by virtue of an arc-quenching arrangement of the generic type having the characterizing features of Claim 1. As regards an improved service switching device, the object is achieved by the features of Claim 12.

According to the invention, the first arc guide rail has a first, rectangular section, which faces the arc formation location, and a second section, which adjoins the first section and is in the form of a rectangular trapezium and whose first limb extends at an angle with respect to the mid-longitudinal axis of the first section and away therefrom. According to the invention, therefore, the arc guide rail has two zones, by virtue of which it is matched better in terms of its geometry to the geometry of the quenching chamber. As a result, the arc run is improved.

In accordance with an advantageous embodiment of the invention, the first arc guide rail is connected, advantageously welded, to an arcing horn which bears the fixed contact piece.

The arcing horn assists the arc in jumping over quickly from the fixed contact piece to the arc guide rail.

In accordance with a particularly advantageous embodiment of the invention, the width of the first section is less than the width of the cutout on that broad side of the arc splitter plate which faces the arc formation location. The arc guide rail is narrow at its side facing the arc formation location, which is advantageous since, as a result, the electrical field is concentrated with a high field density. This results in a high magnetic force on the arc root, which accelerates the process of the arc running into the arc splitter stack.

In accordance with an advantageous embodiment of the invention, the angle $\alpha$ assumed by the first limb of the second section with the mid-longitudinal axis corresponds to the angle $\beta$ assumed by the flank of the V-shaped notch with the mid-longitudinal axis. As a result, further improved matching of the arc guide rail to the geometry of the arc-quenching chamber is achieved. By virtue of the configuration of the second section as a rectangular trapezium, the fact that the first limb is guided at an angle also ensures that a second limb of the trapezium in extension is aligned with the longitudinal side of the first section. A rectangular trapezium, as is known, has two parallel base sides, a shorter one and a longer one, and two limbs which connect the two base sides, and two right angles between a limb and each of the two base sides.

In accordance with an advantageous embodiment of the invention, the short base side of the second section has the same length as the broad side of the first section, and the long base side of the second section extends from the second, rectangular limb of the second section as far as the outer narrow side edge of the adjacent arc splitter plate. The arc guide rail is wider at its rear end, when viewed in the arc running direction, than at its front end. This is advantageous since, as a result, the arc does not burn at a single spot, which could result in material erosion on the arc guide rail and in delayed run-in into the arc splitter stack.

In accordance with an advantageous embodiment of the invention, the projection of the mid-longitudinal axis of the first section in the stacking direction of the arc splitter stack onto the adjacent arc splitter plate coincides with the mid-longitudinal axis of the arc splitter plate. The first section of the arc guide rail is, therefore, symmetrical with respect to the arc splitter plate, which is advantageous as regards rapid arc guidance.

In accordance with an advantageous embodiment of the invention, a third section in the form of a rectangular plate is integrally formed on the long base side of the second section. The third section guides the arc completely as far as to the rear end of the arc splitter stack. In particular, in an advantageous embodiment, the third section can have the same width as the arc splitter plate.

In accordance with an advantageous embodiment of the invention, the third section bears a supporting lug. The supporting lug can be used to hold the arc guide rail when fitting the service switching device in a pocket in the inner side of the housing of the switching device, which is advantageous for fitting.

In accordance with an advantageous embodiment of the invention, the third section has a cutout for passing through a connecting conductor. During fitting in a service switching device, for example, the cutout can provide space for the connection to the coil of a magnetic release.

In accordance with an advantageous embodiment of the invention, the narrow sides at least of the first section are covered by the narrow side at least of a web fitted on the housing inner side. This prevents the arc from jumping over the narrow side edge of the arc guide rail and makes a separate covering part for the narrow side edges of the arc guide rail superfluous.

In accordance with an advantageous embodiment of the invention, in addition, the narrow sides of the limbs of the second section are covered by the narrow sides at least of a web fitted on the housing inner side.

Further advantageous configurations and improvements of the invention and further advantages are given in the dependent claims.

DESCRIPTION OF THE FIGURES

The figures and the description serve for better understanding of the subject matter. Objects or parts of objects which are substantially the same or similar can be provided with the same reference numerals. The figures are merely a schematic illustration of an embodiment of the invention.

In the figures:

In the figures, identical or functionally identical component parts or elements have been provided with the same reference numerals.

FIG. 1 shows an arc splitter stack 6, which comprises arc splitter plates 5 which are stacked one above the other and which are positioned one above the other in a stacking direction perpendicular to the plane of the drawing. In a manner known per se, they are held together and at a distance from one another by lateral parts 29. In a manner known per se, each arc splitter plate 5 has, on a narrow side, a cutout 8 with a V-shaped notch, whose opening faces the arc formation location 7, i.e. is open towards the left in FIG. 1, and which tapers in the form of a funnel symmetrically with respect to a mid-longitudinal axis 13 in the arc running direction, towards the right in FIG. 1. At the base of the V-shaped notch, channel-like extensions of the V-shaped notch can be applied in a manner which is likewise known per se. The flank of the V-shaped notch assumes an angle $\beta$ of approximately 30° with the mid-longitudinal axis 13.

Adjacent to the uppermost arc splitter plate 5 and parallel thereto, there is an arc guide rail 9. Said arc guide rail 9 bears, at the arc formation location 7, i.e. at its left-hand end in FIG. 1, a plate 30, which points perpendicularly upwards, i.e. out of the plane of the drawing in FIG. 1. The plate 30 has an opening 31, through which a striker pin of a magnet coil can be passed. FIG. 2 shows the arc guide rail on its own as an isometric view.

Figure 1:
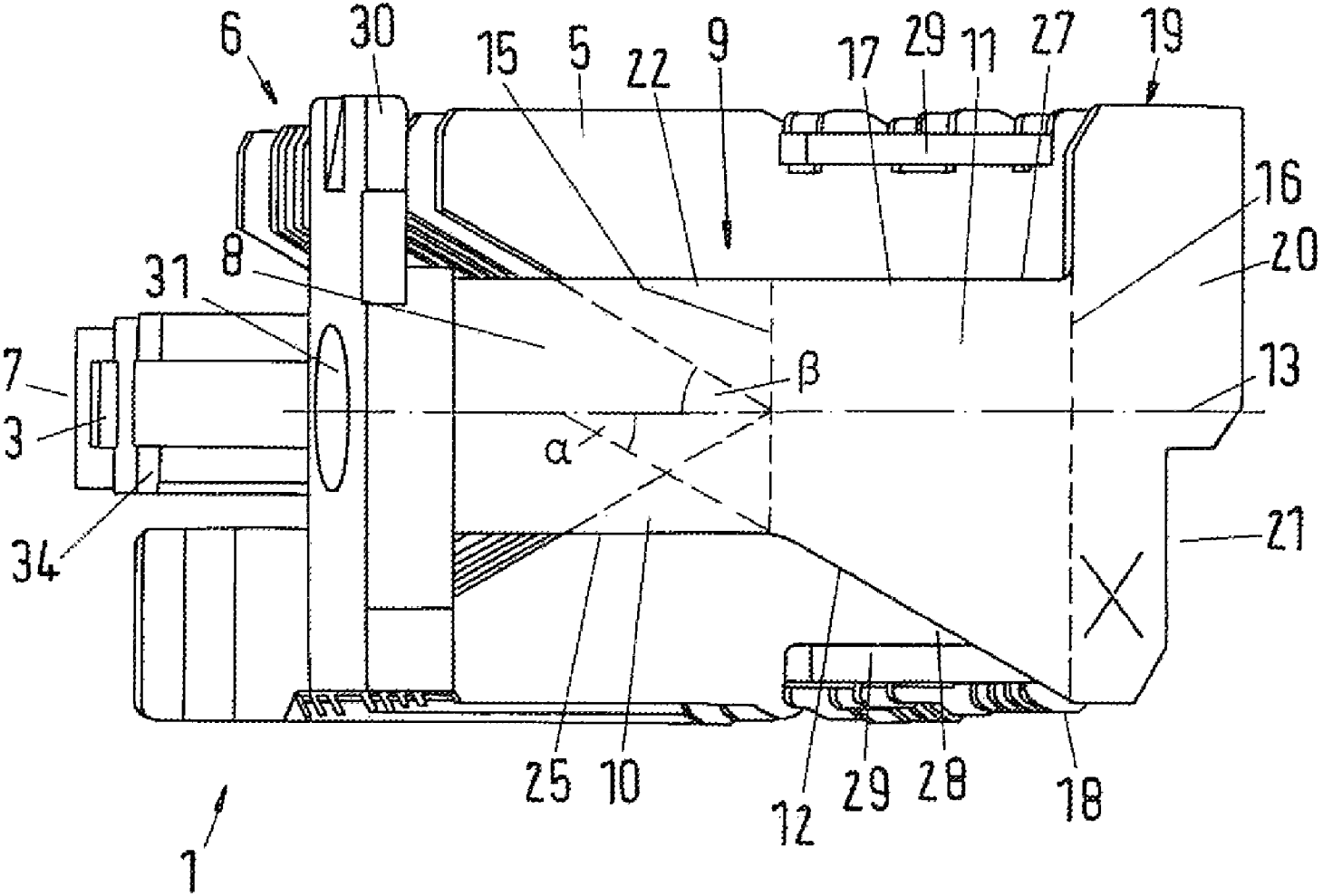
FIG. 1 shows a schematic view of an arc-quenching arrangement according to the invention.
Figure 2:
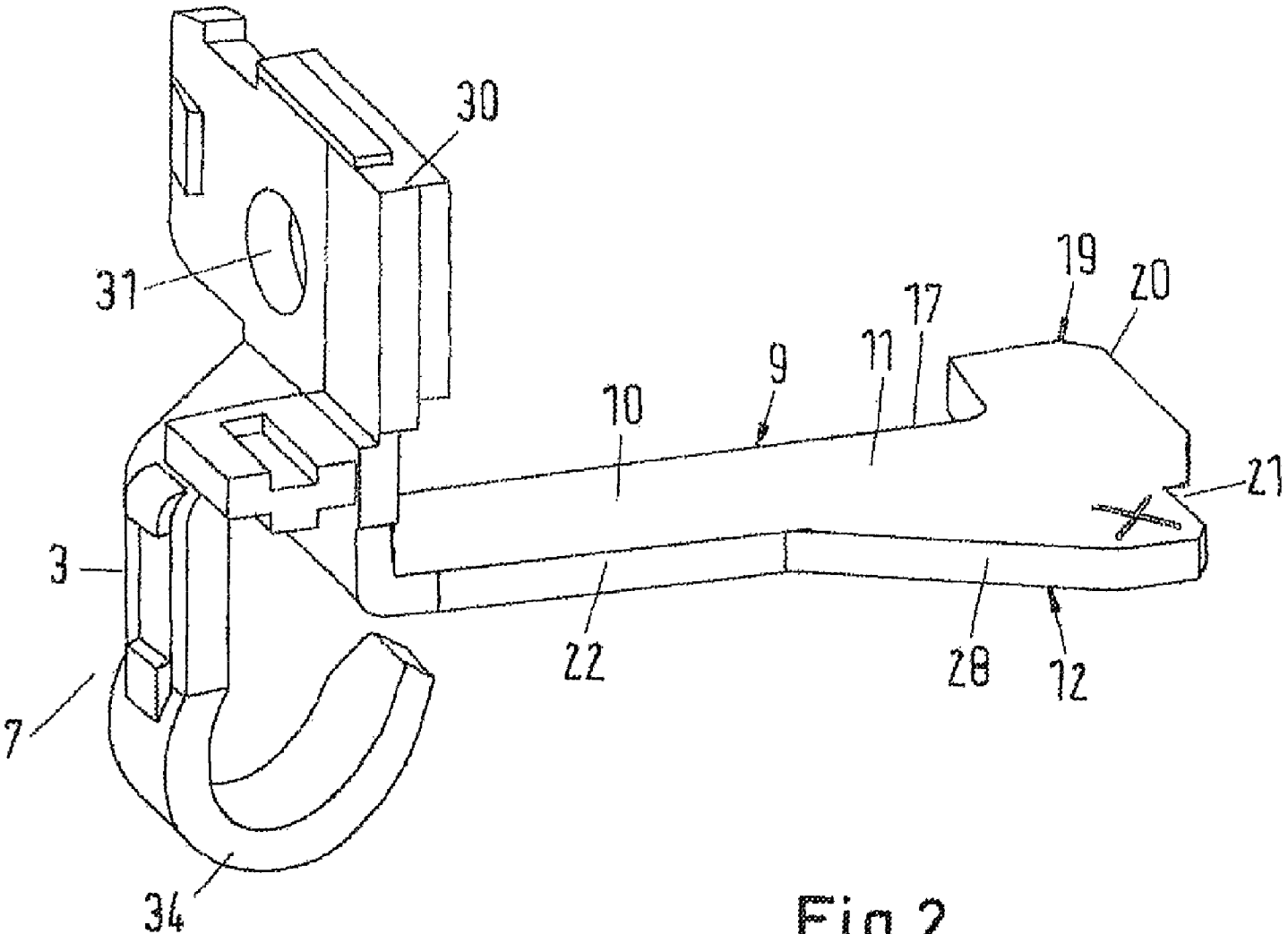
FIG. 2 shows an isometric detail view of an arc guide rail according to the invention with an arcing horn fitted thereon.

Consideration will now be given to FIG. 3. Said figure shows a partial view into an open shell housing of a service switching device 2, in this case a line circuit breaker. The figure shows the area 32 in which the arc splitter stack 6 is accommodated at the holding slots 33 for the arc splitter plates in the inner housing broad side 26. A magnet system 35 of an electromagnetic release known per se is mounted above the arc guide rail 9, in the area between said arc guide rail 9 and the right-hand side of the plate 30. Extending downwards, an arcing horn 34 is connected, for example as a stamped, bent part in the form of a single component part, or welded to the plate 30.

Figure 3:
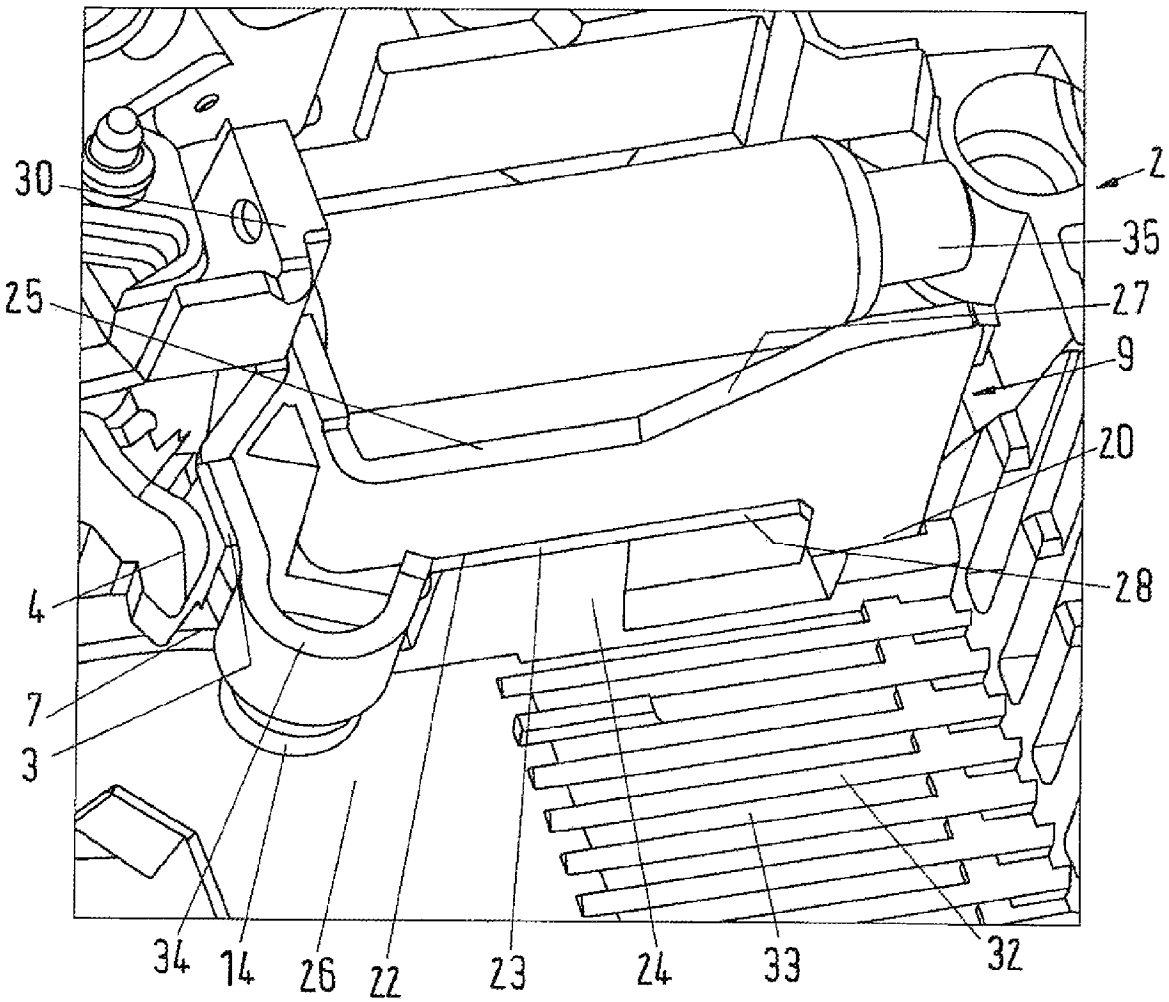
FIG. 3 shows a partial view into an open service switching device with an arc guide rail according to the invention.

The fixed contact piece 3 of a contact point is fitted on the arcing horn 34, and the movable contact piece 4 is located on a movable contact lever and can still be seen at the left-hand edge in FIG. 3. When the contact point opens, the switching arc forms between the fixed and the movable contact pieces, for which reason this zone is also referred to as the arc formation point 7. Since the arc guide rail 9 is connected to the fixed contact piece, it is also referred to as a fixed contact guide rail.

The area to the left of the arc splitter plate area 33 is referred to as the arcing prechamber area 14. The arcing horn 34 protrudes downwards into the arcing prechamber area 14. As a result, the arcing horn 34 is assisted in jumping over from the arc root to the fixed contact guide rail 9.

On the housing inner side 26, a web 24 protrudes into the device interior, and the fixed contact guide rail 9 rests on the narrow side 23 of said web 24 with its narrow side 22. The narrow side 22 of the fixed contact guide rail 9 is, therefore, covered by the web 24. The service switching device 2 in the partial view shown in FIG. 3 is a device with a shell structure. A second housing shell would be placed from above onto the lower housing shell shown in FIG. 3 and would be connected thereto along a peripheral contour line in order to complete the housing. The second housing shell, not illustrated here, likewise bears a web on its inner side, said web, in terms of its narrow side contour, supplementing the narrow side contour 25 of the fixed contact guide rail 9 and being fitted in the housing in such a way that its narrow side contour covers the narrow side 25 of the fixed contact guide rail 9. Both narrow sides 22, 25 of the fixed contact guide rail 9 are, therefore, covered by housing webs in the ready-fitted state of the device. As a result, the arc root is prevented from jumping over the upper side of the fixed contact guide rail 9.

Again back to FIG. 1. The fixed contact guide rail 9 can be considered as comprising three sections 10, 11 and 19. The first section 10 has a rectangular shape, and its width is less than the opening width of the V-shaped notch in the arc splitter plate 5. In terms of length, it extends approximately as far as the height of the base of the V-shaped notch. Its mid-longitudinal axis, in its projection onto the arc splitter plates 5 in the stacking direction thereof, coincides with the mid-longitudinal axis of the arc splitter plates 5, i.e. the first section is arranged symmetrically with respect to the arc splitter plates.

At the level of the abovementioned base of the V-shaped notch, a second section 11 with a circumferential contour of a rectangular trapezium follows. The limb 12 running at an angle of this trapezium forms approximately the same angle with the mid-longitudinal axis 13 as the flanks of the V-shaped notch in the arc splitter plates 5. The narrow side 25 of the fixed contact guide rail 9 forms a bend in its profile from right to left in the arc running direction, i.e. at the height of the base of the V-shaped notch. The limb 17 of the trapezium which runs in a straight line and which forms the right angles with the two base sides 15 and 16 of the trapezium, runs as an extension of the longitudinal side of the first section 10. The second section 11 extends towards the right in the arc running direction until its angled limb 12 comes to lie at the level of the outer edge of the arc splitter plate 5.

The third section 19 adjoins at this point, said third section again being rectangular and being guided up to the rear right as far as the end of the arc splitter plates 5. The third section 19 bears a cutout 21, which provides space, for example, for the welded joint for connecting the coil connection to the coil of the magnet system 35. On the side opposite the cutout 21, the third section 19 bears a rectangular supporting lug 20, with which the fixed contact guide rail 9 is held in the housing in a holding slot in the inner housing wall during fitting.

The fixed contact guide rail 9, as is known in principle, is advantageously manufactured from steel, for example as a stamped, bent part. In the configuration shown by way of example here in accordance with the invention, it has, when viewed in the arc running direction, a first, narrow section, which widens in a second section towards the width of the arc splitter plates. In the narrow, front section, the electrical field is concentrated, and the high field density brings about a high magnetic force onto the arc root and assists rapid run-in of the arc into the arc-quenching chamber. The wide, rear part ensures that the arc does not burn on a single spot. The angle at the bend between the first and second sections corresponds to the angle of the V-shaped notch in the arc splitter plates, and the fixed contact guide rail 9 is matched to the geometry of the arc splitter plates.

LIST OF REFERENCE SYMBOLS

1 Arc-quenching arrangement
2 Electrical service switching device
3 Fixed contact piece
4 Movable contact piece
5 Arc splitter plate
6 Arc splitter stack
7 Arc formation point
8 Cutout
9 First arc guide rail
10 First section
11 Second section
12 First limb
13 Mid-longitudinal axis
14 Arcing prechamber area
15 Short base side
16 Long base side
17 Second limb
18 Narrow side edge of arc splitter plate
19 Third section
20 Supporting lug
21 Cutout
22 Narrow side
23 Narrow side
24 Web
25 Narrow side
26 Housing inner side
27 Narrow side
28 Narrow side
29 Lateral part
30 Plate
31 Opening
32 Area for arc splitter stack
33 Holding slot
34 Arcing horn
35 Magnet system

What is claimed is:

1. An arc-quenching arrangement for an electrical service switching device with a fixed contact piece, comprising:

a movable contact piece;

an arc splitter stack, having arc splitter plates, each arc splitter plate having a cutout, which is open towards an arc formation point which has a V-shaped notch and tapers in the form of a funnel in an arc running direction;

a first arc guide rail, which is associated with the fixed contact piece and which guides an arc into the arc splitter stack, comprising:

a first, rectangular section, which faces the arc formation location, and a second section, which adjoins the first section and is in a form of a rectangular trapezium, the second section including a first limb that extends at an angle with respect to a mid-longitudinal axis of the first section and away therefrom; and a second arc guide rail, which is associated with the movable contact piece.

2. The arc-quenching arrangement according to claim 1, wherein the first arc guide rail is connected to an arcing horn which bears the fixed contact piece.

3. The arc-quenching arrangement according to claim 1, wherein a width of the first section is less than the width of the cutout on a broad side of the arc splitter plate which faces the arc formation location.

4. The arc-quenching arrangement according to claim 1, wherein an angle $\alpha$ assumed by the first limb of the second section with the mid-longitudinal axis corresponds to an angle $\beta$ assumed by a flank of the V-shaped notch with the mid-longitudinal axis.

5. The arc-quenching arrangement according to claim 1, wherein a short base side of the second section has a same length as a broad side of the first section, and a long base side of the second section extends from a second, rectangular limb of the second section as far as an outer narrow side edge of an adjacent arc splitter plate.

6. The arc-quenching arrangement according to claim 5, wherein a third section in a form of a rectangular plate is integrally formed on a long base side of the second section.

7. The arc-quenching arrangement according to claim 6, wherein the third section bears a supporting lug.

8. The arc-quenching arrangement according to claim 6, wherein the third section has a cutout for passing through a connecting conductor.

9. The arc-quenching arrangement according to claim 1, wherein a projection of the mid-longitudinal axis of the first section in a stacking direction of the arc splitter stack onto an adjacent arc splitter plate coincides with the mid-longitudinal axis of the arc splitter plate.

10. The arc-quenching arrangement according to claim 1, wherein narrow sides at least of the first section are covered by a narrow side at least of a web fitted on a housing inner side.

11. The arc-quenching arrangement according to claim 10, wherein the narrow sides of limbs of the second section are covered by narrow sides at least of a web fitted on a housing inner side.

12. Electrical service switching device, comprising:

a fixed contact piece;

a movable contact piece;

an arc splitter stack having arc splitter plates, each arc splitter plate having a cutout, which is open towards an arc formation point, has a V-shaped notch and tapers in a form of a funnel in an arc running direction;

a first arc guide rail, which is associated with the first contact piece and which guides an arc into the arc splitter stack, comprising:

a first, rectangular section, which faces the arc formation location, and a second section, which adjoins the first section and is in a form of a rectangular trapezium, the second section including a first limb that extends at an angle with respect to a mid-longitudinal axis of the first section and away therefrom, and a second arc guide rail, which is associated with the movable contact piece.

13. The electrical service switching device according to claim 12, wherein the first arc guide rail is connected to an arcing horn, which bears a fixed contact piece and protrudes into an arcing prechamber area.

14. The electrical service switching device according to claim 12, wherein a width of the first section is less than the width of the cutout on a broad side of the arc splitter plate which faces the arc formation location.

15. The electrical service switching device according to claim 12, wherein an angle $\alpha$ assumed by the first limb of the second section with the mid-longitudinal axis corresponds to an angle $\beta$ assumed by a flank of the V-shaped notch with the mid-longitudinal axis.

16. The electrical service switching device according to claim 12, wherein a short base side of the second section has a same length as a broad side of the first section, and a long base side of the second section extends from a second, rectangular limb of the second section as far as an outer narrow side edge of an adjacent arc splitter plate.

17. The electrical service switching device according to claim 16, wherein a third section in a form of a rectangular plate is integrally formed on a long base side of the second section.

18. The electrical service switching device according to claim 17, wherein the third section bears a supporting lug.

19. The electrical service switching device according to claim 17, wherein the third section has a cutout for passing through a connecting conductor.

20. The electrical service switching device according to claim 12, wherein a projection of the mid-longitudinal axis of the first section in a stacking direction of the arc splitter stack onto an adjacent arc splitter plate coincides with the mid-longitudinal axis of the arc splitter plate.

21. The electrical service switching device according to claim 12, wherein narrow sides at least of the first section are covered by a narrow side at least of a web fitted on a housing inner side.

22. The electrical service switching device according to claim 21, wherein narrow sides of limbs of the second section are covered by narrow sides at least of a web fitted on a housing inner side.

* * * * *